United States Patent [19]

Meiler

[11] Patent Number: 4,493,197

[45] Date of Patent: Jan. 15, 1985

[54] FOULARD MACHINE

[76] Inventor: Hans E. Meiler, Königsberger Str. 7a, D-8676 Schwarzenbach, Fed. Rep. of Germany

[21] Appl. No.: 426,462

[22] Filed: Sep. 29, 1982

[30] Foreign Application Priority Data

May 5, 1982 [DE] Fed. Rep. of Germany ..... 3216726

[51] Int. Cl.[3] ..... D06B 1/14

[52] U.S. Cl. ..... 68/202; 15/256.51; 100/917; 101/363; 118/246; 118/262

[58] Field of Search ..... 68/202, 203; 101/363; 118/261, 262, 414, 246; 100/917; 29/116 AD; 15/256.5, 256.51, 256.52

[56] References Cited

U.S. PATENT DOCUMENTS 3,216,349 11/1965 Kraft ..... 68/202 X
3,456,582 7/1969 McClenathan ..... 100/917 X
3,647,525 3/1972 Dahlgren ..... 118/262 X
3,768,438 10/1973 Kumpf ..... 118/262
4,376,330 3/1983 Weidinger et al. ..... 100/917 X

FOREIGN PATENT DOCUMENTS 2911166 10/1980 Fed. Rep. of Germany ..... 118/262

*Primary Examiner*—Philip R. Coe

[57] ABSTRACT

Described is a foulard machine with the minimum possible application of liquor. For this purpose, a wiper is held against the circumference of an enlacing roller by means of forces of magnetic repulsion. The wiper has a plurality of recesses or indents next to one another which act to convey the liquor. Any out-of-rounds of the enlacing roller are compensated for by the forces of magnetic repulsion so that the wiper abuts against the circumference of the roller uniformly over its entire length.

11 Claims, 5 Drawing Figures

FOULARD MACHINE

DESCRIPTION

This invention relates to a foulard machine comprising an enlacing roller for a textile web to be treated and a trough for accommodating a liquor which is taken up out of said trough and applied to said web by a wiper which abuts against the circumference of the enlacing roller and wipes off any excess liquor, said wiper having on its contact surface abutting against the enlacing roller a plurality of adjacent recesses or indents and being held in abutment against the circumference of the enlacing roller over its entire length by means of magnetic forces.

Such a foulard is described by European laying-open print 47,484 or U.S. patent appln. Ser. No. 316,460, filed Oct. 30, 1981 in the name of Meiler et al: Compared to other hitherto employed foulards, this known foulard features the least possible application of liquor. This is accomplished there, on the one hand, by providing a plurality of adjacent recesses or indents over the entire length of the wiper which serve as passageways for the liquor. The recesses have a depth of a few tenths of a millimeter. In the areas between these passageways, the entire length of the wiper abuts as uniformly as possible against the circumference of the enlacing roller. This is accomplished there by disposing a magnetic rod in the enlacing roller directly opposite the wiper. This causes the wiper to be drawn towards the magnetic rod and thus towards the circumference of the enlacing roller over the entire length of the wiper.

Practice has shown, however, that this known foulard does not operate to complete satisfaction. Since the operation is to be carried out using minimal quantities of liquor, it is absolutely necessary that the wiper drawn against the enlacing roller abut uniformly over its entire length because otherwise liquor will be applied in a non-uniform manner relative to the width of the product. This necessitates a completely cylindrical enlacing roller with an absolutely uniform surface.

It has been found in practice, however, that the enlacing roller cannot adequately fulfill this condition owing to its low band strength. Even the inherent weight of the roller alone results in sagging which impairs the required uniform abutment of the wiper on the circumference of the enlacing roller. Moreover, the enlacing roller can easily be mechanically damaged resulting in dents or the like which also cause the wiper to abut unevenly.

Since the wiper is drawn towards the interior of the enlacing roller due to the force of magnetic attraction, it is not possible to arbitrarily increase the stability of the roller, e.g. by providing thicker walls or by a thicker rubber layer, because the magnetic force decreases as the square of the distance between the magnetic rod located in the enlacing roller and the wiper. For this reason, the thickness of any rubber layer which may be provided on the roller cannot be increased.

The object of the invention is to develop a foulard of the type mentioned at the outset such that there is minimum liquor application over the entire width of the respective web based on the afore-mentioned principle of the use of a wiper comprising a plurality of adjacent recesses which are held against the circumference of the enlacing roller by means of magnetic force.

To accomplish this object, the invention is characterized in that the wiper is designed as a magnetic wiper and is pressed against the circumference of the enlacing roller which is coated with an elastic material, said wiper being pressed against said roller by forces of magnetic repulsion with the aid of a magnetic bar which is provided parallel to said wiper on the side facing away from the enlacing roller.

These measures make it possible to provide any arbitrary, if desired arbitrary small, spacing between the magnetic wiper and the magnetic bar because, unlike the afore-described prior art, the magnetic bar is not provided inside the enlacing roller, but rather outside the same. The jacket of the enlacing roller can therefore be designed to be as thick as required to fulfill the respective conditions, in particular to reliably prevent any sagging of the enlacing roller jacket whatsoever, Also providing the enlacing roller with a coating of an elastic material, preferably designed as a rubber layer, compensates for any other irregularities. The enlacing roller jacket including the coating layer can therefore be chosen to be so thick that the wiper abuts perfectly over its entire length aainst the circumference of the enlacing roller with the raised portions located between the recesses thereof. The wiper is pressed against the circumference of the enlacing roller over its entire length by means of magnetic force.

The magnetic wiper preferably consists of a rotatably mounted pipe with an engraved surface in which there are provided permanent magnets with pole shoes located therebetween and clamped into position by a continuous mandrel. The mandrel keeps the permanent magnets fixed axially in the pole shoes thereof. Unlike the afore-described prior art, in which the wiper is non-magnetic and consists of a magnetizable material, i.e. chromium, the wiper in accordance with the invention is designed to be magnetic, i.e. it is a magnetic wiper.

The magnetic wiper, however, may also be designed as a polygonal pipe with recesses cut into one side in a comb-like fashion, permanent magnets with pole shoes being inserted into said pipe one next to the other and being fixed into position there in a suitable manner.

The magnetic bar includes magnetic elements with pole shoes which are positioned opposite the same pole shoes of the magnetic wiper.

The magnetic elements of the magnetic bar can be permanent magnets or solenoid magnets. The advantage of using solenoid magnets is that the magnetic force can be actuated and deactuated as desired, whereas no separate power supply is required if permanent magnets are used.

The spacing between the magnetic wiper and the magnetic bar is infinitely adjustable in order to be able to appropriately regulate the pressure force.

It is important that the magnetic wiper and the magnetic bar be fixed in an axial direction. Since they respectively lie opposite the same poles, they tend to deflect to one side and this must be prevented.

It is necessary that the magnetic bar and the magnetic wiper be designed to be removed for cleaning and repair work. To avoid injury by the magnets which may also exert an attraction then as well, it is preferred that the magnetic bar be mounted in a guide such that the magnetic bar can be moved out of the area of influence of the magnetic wiper and that during this movement a cover of a non-magnetic material is simultaneously positioned in front of the magnetic bar. The cover should have such a thickness that magnetic force can no longer attract the magnetic wiper towards the magnetic bar.

It is also preferred for the same reason if the magnetic wiper is secured to a pivotal bar, a sleeve of a non-magnetic being provided which is adapted to be slid onto the magnetic wiper. This, for instance, can be a sleeve which has a slot in the axial direction and which can be slid onto the magnetic wiper when this is pivoted away from the enlacing roller. The thickness of this sleeve can also be selected such that the magnetic wiper and the magnetic bar are no longer attracted to each other by magnetic force.

It also serves to deposit the most uniform possible liquor application to the respective web if at least one pressure roller is provided in back of a guide roller in the direction of rotation of said enlacing roller, the spaced relation between said pressure roller and the enlacing roller being adjustable. This measure is already known per se from the afore-mentioned European laying-open print.

The invention will now be described in the following in more detail with reference to an embodiment which reveals other essential features, in which.

Figure 1:
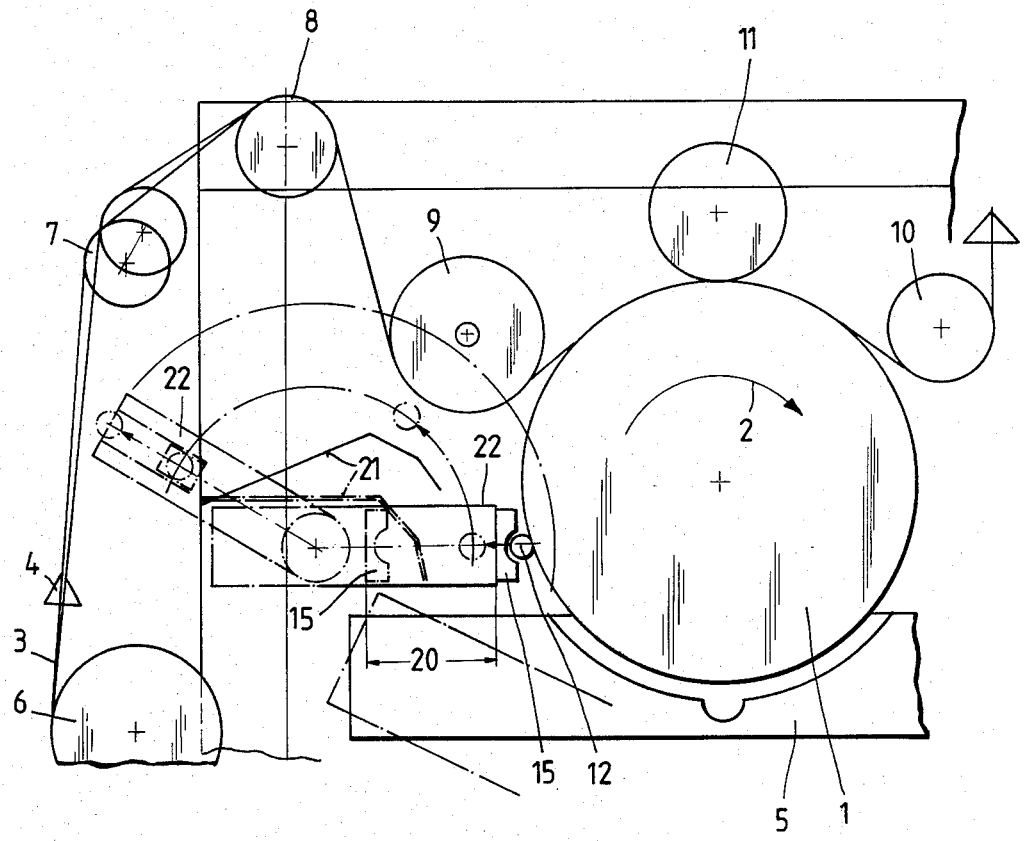
FIG. 1 shows in a schematic end view the essential components of a novel foulard.

To start with, the basic structure of the foulard machine will be explained with reference to FIG. 1. An enlacing roller 1 is provided which rotates in the direction indicated by arrow 2. The jacket of the enlacing roller possesses adequate strength and is provided with a rubber coating.

A liquor is to be deposited in a very uniform manner with minimum liquor consumption onto a web 3 which passes through the foulard machine in the direction indicated by arrow 4. The liquor is contained in a trough 5.

For this purpose, the web which issues from a first guide or supply roller 6 passes over additional guide rollers 7, 8, 9 and 10 as illustrated diagrammatically in FIG. 1. The web is thus positioned on the circumference of the enlacing roller 1 between the guide rollers 9 and 10. A pressure roller 11 can be provided between these two guide rollers. The spacing between this pressure roller 11 and the enlacing roller 1 is preferably adjustable. A plurality of such adjustable pressure rollers may also be provided. Furthermore, the guide rollers may also be adjustable as indicated at 7.

Figure 4:
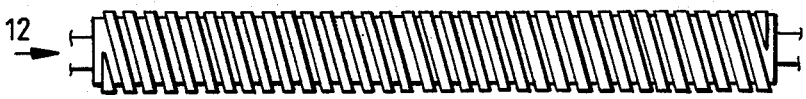
FIG. 4 shows a view of a preferred wiper embodiment.
Figure 5:
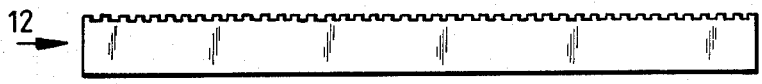
FIG. 5 shows a view of another possible wiper embodiment.

The enlacing roller 1 dips into the trough 5 and takes up liquor there during its rotation. Any excess liquor is removed during the rotation of the enlacing roller by a magnetic wiper 12 which presses against the circumference of the enlacing roller. The magnetic wiper has a plurality of recesses or indents adjacent one another as shown in FIGS. 4 and 5. The recesses are 0.15 mm deep, for example. When designed as a type of thread as shown in FIG. 4, this thread has a lead of 0.5 mm, for example.

The wiper is magnetic. It is therefore designed as a pipe into which permanent magnets 13 and pole shoes 14 are alternatively inserted. (Refer to FIG. 2.) This alternatively imparts to the pole shoes a different magnetic orientation characterized as "N" and "S".

Figure 2:
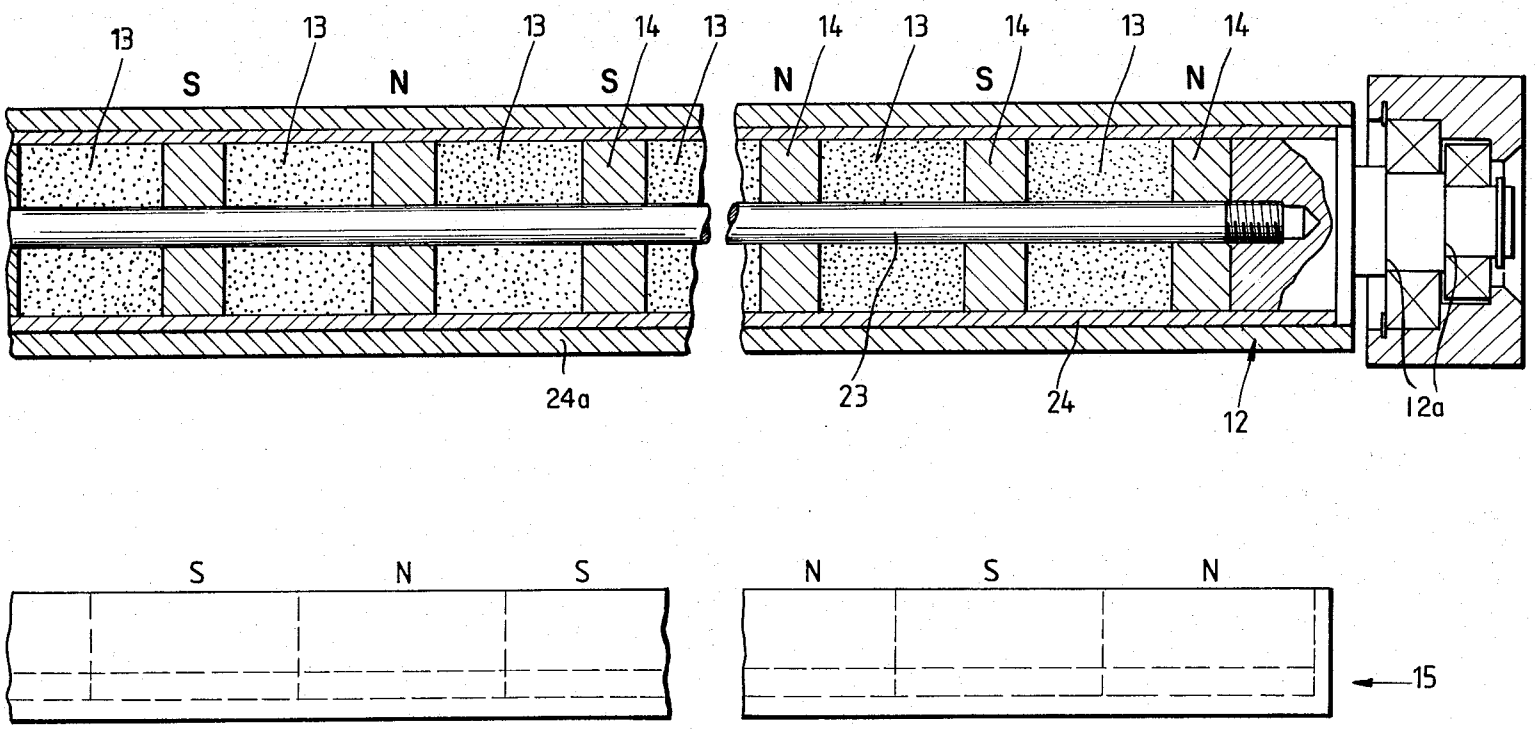
FIG. 2 shows a sectional view through the wiper on an enlarged scale compared to the illustration in FIG. 1, the wiper being indicated opposite the magnetic bar at an enlarged spacing for the sake of clarification.

FIG. 2 also reveals that the north poles or south poles of the magnetic wiper are positioned opposite the north poles or south poles of a magnetic bar 15. The drawing shows that these are somewhat broader than the north poles and south poles of the magnetic wiper. They can, however, also be equally broad or even somewhat narrower. It is important that a south pole always lies opposite a south pole and a north pole opposes a north pole.

Figure 3:
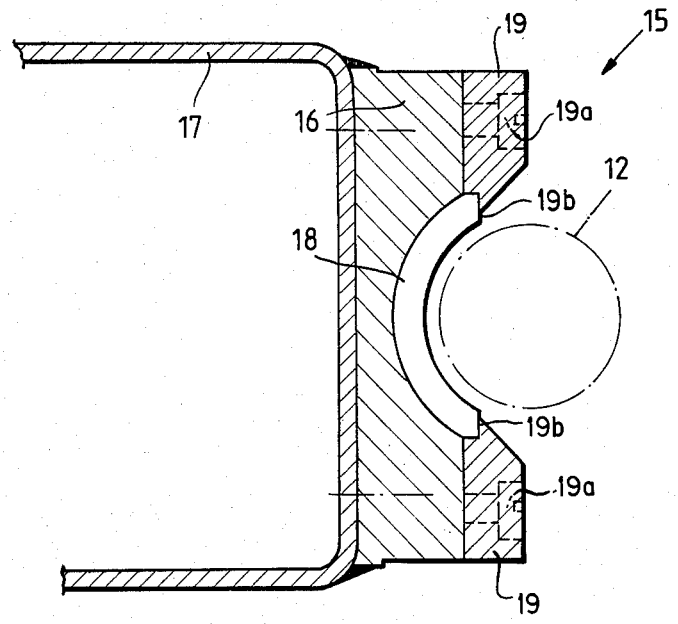
FIG. 3 shows a sectional view through the magnetic bar with mounting means.

FIG. 3 shows the structure of the magnetic bar 15. This consists of a rod 16 which is mounted on a U-shaped bracket 17. An approximately semicylindrical recess is provided in the centre of the rod, corresponding semicylindrical magnetic elements 18 being inserted into said recess adjacent one another.

The magnetic elements are either permanent magnets or solenoid magnets.

The magnetic elements are mounted on support bars 19 which are screwed by screws **19*a* to the sides of the rod 16 and each of which has a shoulder 19*b*** enabling them to project over the semimonocoque magnetic elements.

FIG. 3 also shows the magnetic wiper 12 and reveals that the magnetic elements 18 of the magnetic bar 15 abut in a semimonocoque manner against the circumference of the magnetic wiper 12 in an adjustable spaced relation.

FIG. 2 shows the mounting of the wiper which is pivotally mounted in this embodiment according to FIG. 4. The steps **12*a*** illustrated in the drawing cause axial fixation of the wiper so that the same poles are always positioned opposite each other.

For cleaning and repair the trough 5 can be tilted downwardly as indicated. The magnetic bar 15 is adapted to be moved radially outwardly along the path 20 as indicated in FIG. 1. A cover 21 automatically pivots downwardly in front of the magnetic bar, thereby protecting it.

The magnetic wiper 12 can also be removed from the enlacing roller. For this purpose, the magnetic wiper including the mounting protection thereof is displayed radially outwardly by a few centimeters and can be readily pivoted as indicated in the drawing by means of a pivotal bar 22 which has an appropriate accommodation for the magnetic wiper mounting. After the magnetic wiper has been pivoted out of position, a sleeve **24*a*** also consisting of a non-magnetic material, is placed over the magnetic wiper to prevent it from coming into contact with iron particles.

FIG. 2 also shows that the premanent magnets 13 and their pole shoes 14 are mounted and clamped in immobile positions in the pipe 24 of the magnetic wiper 12 by means of a suitable mandrel 23 which passes through these elements.

I claim:

1. A foulard machine for applying liquor to a web of textile material comprising an enlacing roller coated with an elastic material; a trough for accommodating a liquor which is taken up out of said trough and applied to a web by the enlacing roller; a magnetic wiper which abuts against the circumference of the enlacing roller and wipes off any excess liquor, said wiper having on its contact surface abutting against the enlacing roller a plurality of adjacent recesses or indents and being held in abutment against the circumference of the enlacing roller over its entire length by means of magnetic forces; and a magnetic bar disposed parallel to said wiper on the side facing away from the enlacing roller; the wiper being pressed against the circumference of the enlacing roller; the wiper being spaced from the magnetic bar and pressed against said roller by forces of magnetic repulsion with the aid of the magnetic bar; the spacing between the magnetic wiper and the magnetic bar being infinitely adjustable.

2. The foulard machine according to claim 1, wherein the magnetic wiper comprises a rotatably mounted pipe with an engraved surface in which there are provided permanent magnets having pole shoes located therebetween the clamped into position by a continuous mandrel.

3. The foulard machine according to claim 2, wherein the magnetic bar includes magnetic elements with having pole shoes which are positioned opposite the pole shoes of the magnetic wiper.

4. The foulard machine according to claim 3, wherein the magnetic elements of the magnetic bar are permanent magnets.

5. The foulard machine according to claim 3, wherein the magnetic elements of the magnetic bar are solenoid magnets.

6. The foulard machine according to claim 1, wherein the coating on the enlacing roller is of rubber.

7. The foulard machine according to claim 1, wherein the magnetic wiper and the magnetic bar are fixed in an axial direction.

8. The foulard machine according to claim 1, wherein the magnetic bar is mounted in a guide such that the magnetic bar can be moved out of the area of influence of the magnetic wiper, and comprising a cover of a non-magnetic material movable into a position in front of the magnetic bar when the magnetic bar is moved out of the area of influence of the magnetic wiper.

9. The foulard machine according to claim 1, wherein the magnetic wiper is secured to a pivotable bar.

10. The foulard machine according to claim 9, comprising a sleeve of non-magnetic material adapted to be slid onto the magnetic wiper.

11. The foulard machine according to claim 1, wherein at least one pressure roller is provided, spaced from the enlacing roller and in back of a guide roller in the direction of rotation of the enlacing roller, the spacing between the pressure roller and the enlacing roller being adjustable.

* * * * *